US006046155A

United States Patent [19]

Trinh et al.

[11] Patent Number: 6,046,155

[45] Date of Patent: Apr. 4, 2000

[54] DRYER-ADDED FABRIC SOFTNER COMPOSITION COMPRISING CHLORINE SCAVENGER TO PROVIDE COLOR AND OTHER FABRIC BENEFITS

[75] Inventors: Toan Trinh, Maineville; Donald Marion Swartley, Cincinnati; Alessandro Corona, III, Maineville; John William Smith, Fairfield; Ronghui Wu, Loveland, all of Ohio

[73] Assignee: The Procter & Gamble Company, Cincinnati, Ohio

[21] Appl. No.: 09/275,845

[22] Filed: Mar. 24, 1999

Related U.S. Application Data

[62] Division of application No. 08/937,904, Sep. 25, 1997, abandoned.

[51] Int. Cl.[7] ..... C11D 3/30

[52] U.S. Cl. ..... 510/516; 510/520

[58] Field of Search ..... 510/516, 520

[56] References Cited

U.S. PATENT DOCUMENTS

| | | | |
|---|---|---|---|
| 3,442,692 | 5/1969 | Gaiser | 117/120 |
| 4,077,891 | 3/1978 | Beimesch et al. | 252/8.8 |
| 4,095,946 | 6/1978 | Jones et al. | 8/137 |
| 4,108,600 | 8/1978 | Wong | 8/137 |
| 4,129,964 | 12/1978 | Cogliano et al. | 521/107 |
| 4,421,792 | 12/1983 | Rudy et al. | 427/242 |
| 4,511,495 | 4/1985 | Melville | 252/522 |
| 5,300,238 | 4/1994 | Lin et al. | 252/8.6 |
| 5,460,736 | 10/1995 | Trinh et al. | 252/8.8 |
| 5,503,756 | 4/1996 | Corona, III et al. | 252/8.8 |

FOREIGN PATENT DOCUMENTS

| | | | |
|---|---|---|---|
| 0 332 270 B1 | 9/1989 | European Pat. Off. | C11D 3/00 |

OTHER PUBLICATIONS

Aldrich Chemical Catalog, 1994–1995, Aldrich Chemical Co., Inc., Wilwaukee WI, pp. 487, 640, 764 and 1433, 1994, No Month Available.

*Primary Examiner*—Yogendra Gupta
*Assistant Examiner*—John R. Hardee
*Attorney, Agent, or Firm*—Jason J. Camp

[57] ABSTRACT

The present invention relates to the use of a dryer-added fabric softener composition, after a normal wash process, said composition having optimal characteristics for providing good coverage of fabrics that are treated, and optionally comprising at least one fabric softener component, for imparting fabric appearance benefits. The invention comprises the softener compositions in packages in association with instructions for their use in the dryer to provide protection for the fabrics, especially color care. Dryer-added fabric softener compositions containing chlorine scavenger to protect colored fabrics from chlorine in the next wash cycle are disclosed.

5 Claims, No Drawings

DRYER-ADDED FABRIC SOFTNER COMPOSITION COMPRISING CHLORINE SCAVENGER TO PROVIDE COLOR AND OTHER FABRIC BENEFITS

This is a Divisional patent application of U.S. patent application Ser. No. 08/937,904, filed Sep. 25, 1997 now abandoned.

FIELD OF THE INVENTION

The present invention relates to dryer-added fabric softener compositions. More particularly, it relates to the use of said fabric softening compositions for imparting fabric appearance benefits, especially color maintenance and color appearance recovery benefits, to fabrics.

BACKGROUND OF THE INVENTION

Processes such as wearing, washing, rinsing and/or tumble-drying of fabrics, e.g., clothing, bedding, household fabrics like table linens, are a normal part of the consumer's use of fabrics. However, Applicants have determined that such processes produce a loss of fabric appearance, that is at least partly in the color fidelity and definition of the fabrics.

The problem has been found exacerbated at the location of the stress points such as seams and zippers but also influenced by the overall characteristics of the fabric, e.g., dye type, weave, thread count, fiber type, etc., and the composition of the laundry load, e.g., size, weight, color, and number of items. This problem has also been found further exacerbated after multiple washing cycles.

Fabric softener compositions are known in the art for imparting benefits such as softness and/or antistatic properties and/or freshness impression, to the rinsed and/or dried fabric, as generally described in U.S. Pat. No. 4,834,895 page 1 lines 19 to 32. Although dryer added fabric softener articles comprising compositions containing primarily di(hydrogentatedtallowalkyl)dimethylammonium methyl sulfate have been in use for many years, the Applicants have now surprisingly found that the use of such a dryer-added fabric softening composition comprising a fabric softener component can ameliorate the problem of appearance loss, e.g., fuzziness and/or discoloration of the fabric.

An advantage of the invention is therefore to provide fabrics with effective color fidelity and definition. Such advantage is also seen to be greatly enhanced after multiple washing cycles.

Not to be bound by theory, it is believed that by delivering the softener component in the drying cycle, the loss in the fabric appearance such as the fabric discoloration is either mitigated in the drying cycle or inhibited or reduced in the next wash cycle. It is possible to even recover fabric appearance, that is, restore color fidelity.

SUMMARY OF THE INVENTION

The present invention relates to fabric softener compositions that have optimum ability to distribute an effective amount of fabric softener active over a sufficient portion of the surfaces of fabrics to provide the benefit of fabric appearance protection/maintenance, said compositions preferably comprising at least one fabric softener component, for inhibiting or reducing loss and/or effecting recovery of fabric appearance, e.g., ingredients that improve the color maintenance and/or recovery. The invention especially, relates to the education of the consumer of this fabric appearance protection/maintenance benefit, so that the consumer can take advantage of it. The invention especially relates to compositions containing softener actives more biodegradable than the di(hydrogenated tallowalkyl) dimethylammonium methyl sulfate used heretofore. In order to use the more biodegradable softener actives, one typically needs to select the active and/or adjust the physical characteristics, as disclosed herein, to achieve the physical characteristics acceptable for best fabric appearance benefits performance. For lower melting actives, e.g., one can add higher melting components.

Since the characteristics to provide the appearance benefits can diminish the in-wear static benefits provided by lower melting fabric softener compositions, it can be desirable to provide some of the lower melting fabric softener compositions as one, or more, separate compositions, e.g., as separate areas on a substrate, as disclosed hereinafter.

DETAILED DESCRIPTION OF THE INVENTION

The present invention relates to the use, as a dryer activated softener, of an effective amount of a fabric softener composition preferably having the following properties, for inhibiting, or reducing loss of fabric appearance and/or recovery of fabric appearance:

1) the composition has a peak melt temperature (definition herein below) between about 40° C. and about 75° C., more preferably between about 50° C. and about 75° C.;
2) the composition's fraction of enthalpy below about 40° C. (definition herein below) is less than about 40%, preferably less than about 30%, and more preferably less than about 20%, as measured by DSC (conditions specified herein below);
3) the composition's dissolution rate (definition herein below) in water is less than about 10%, preferably less than about 5%, and more preferably less than about 3%;
4) optionally, but desirably, the composition is slippery when wet, ("wet slip" definition herein below), and
5) optionally, but desirably, the composition's release rate (definition herein below) from the sheet is more than about 65%, preferably more than about 75%, and more preferably more than about 85%,
6) optionally, but preferably, the composition comprising fabric softener actives having greater biodegradability than di(hydrogenated tallowalkyl)dimethylammonium methyl sulfate.

METHODS FOR DETERMINING THE DESIRED PROPERTIES

Differential Scanning Calorimetry (DSC) to determine Peak Melt Temperature and Fraction of Enthalpy below about 40° C.

The thermal behavioral characteristics of a fabric conditioner are determined using a Perkin Elmer DSC7® calorimeter and 7 Series/Unix® software. Samples are prepared and weighed (approximately 20 mg–30 mg) precisely into the measuring pan on a Perkin Elmer AD-4® Auto balance. The measuring pan containing the sample is sealed and placed in the calorimeter. An empty sealed pan is used as the reference cell.

The following temperature program parameters are used to gather the thermal data:

The sample is cooled to about −30° C. and held for about 2 mins. Recording begins as the sample is then heated from about −30° C. at a rate of about 5° C./min until the temperature reaches about 80° C. The sample is held at about 80° C. for about 2 mins. before the sample is cooled at a rate of about −5° C./min until the sample reaches about −30° C. The amount of enthalpy required to heat the sample through this temperature program is recorded digitally.

The "melt peak" is determined as the temperature at which the largest amount of heat is required to continue raising the temperature at the desired rate.

The percent of enthalpy required to raise the temperature of the sample from −30° C. to 40° C. (% enthalpy <40° C.) is determined by dividing the amount of enthalpy required to heat the sample from about −30° C. to about 40° C. by the total enthalpy required to heat the sample from about −30° C. to about 80° C. This fraction is then multiplied by 100.

Dissolution of Fabric Conditioner Compositions in Water at 35° C. (Dissolution Rate)

The composition to be tested is heated until molten in an oven at about 80° C. The hot liquid is poured into an approximately 4 cm×4 cm×0.6 cm plastic weighing dish and allowed to cool to room temperature. The solidified material to be tested is removed from the dish, weighed, and placed inside an approximately 9 cm×5 cm, 4 denier, 1 g per about 500 square centimeters, spun bonded polyester bag. The open end of the bag is folded over three times, sealed with a clamp and placed back in the weighing dish. The bag, sample clamp and weighing dish are weighed together. The bag is then removed from the dish and clamped to one of four ends of a straight cross agitator blade connected to a shaft. The shaft is connected to a motor capable of consistently maintaining about 100 RPM. Each blade extends about 7 cm from the center shaft. The sample is prepared four times and one is placed on each of the four blades of the agitator. This balances the agitator and produces data from four repetitions of the same sample. The agitator and bags are submerged to the midpoint of a water bath of approximately 40 cm×50 cm dimensions and 12 cm deep which is maintained with water flowing at about 1 liter/min. and at about 35° C. by a water recirculating heater. The agitator is turned on and run at about 100 RPM for about 30 minutes. The samples are raised out the bath, removed from the agitator, placed back in the weighing dish and dried in an oven at about 70° C. overnight. The samples are removed from the oven and allowed to come to room temperature and then weighed. The bag, sample clamp and weighing dish are weighed together.

The after bath weight is subtracted from the before bath weight to determine the amount of material dissolved. The percent loss is calculated by dividing the amount lost by the initial weight of the material tested×100.

Wet Slip

Molten fabric conditioner compositions are mixed and poured into approximately 2"×2"×1" (about 5.08 cm×5.08 cm×2.54 cm) molds and allowed to solidify and cool to room temperature. The compositions are removed from the mold and held in the hand under an approximately 2 liter/min stream of water at about 60–70° F. (about 15–21° C.). After holding the material under the water stream for about 10 seconds, the material was then rubbed with the thumb to assess the slipperiness of the wetted composition surface. The wet slip properties of the sample was determined by grading versus the following controls: Stearic fatty acid (Industrene 7018) is given an arbitrary grade of 1 for its poor wet slip properties, di(hydrogenated tallowalkyl)di (methyl)ammonium methyl sulfate (Witco Varisoft 137®) is given an arbitrary grade of 3 for its excellent wet slip properties. Compositions with intermediate wet slip properties (i.e., between 1 and 3) are given a grade of 2.

Percent Active Release from a Dryer Sheet During Use (Release Rate)

An approximately 7 pound bundle of garments is washed in about 95° F. (about 35° C.) water using a standard detergent composition and rinsed in about 62° F. (about 17° C.) water using a standard sturdy/cotton laundry cycle. The dryer sheet's initial total weight is recorded. The dryer sheet is placed on top the washed bundle that has been transferred to the tumble dryer. The bundle and dryer sheet are tumble-dried for about 40 mins. under high heat and then allowed to tumble under no heat for about 10 mins. The dryer sheet is then weighed to determine the final total weight of the sheet. The amount of softener transferred to the bundle is the difference between the initial and final dryer sheet weights. If the initial substrate weight is unknown, the initial coating weight is determined by stripping the substrate of all fabric softener as follows. The used dryer sheets are labeled, and placed in mesh bags and washed twice in about 140° F. (about 60° C.) water using a standard detergent composition, followed by twice washing in about 140° F. (about 60° C.) water without detergent. The stripped sheets are then dried for about 40 mins. under high heat and then about 10 mins. with no heat in a tumble dryer. The stripped and dried substrate weight is recorded. The % active released is calculated as: (initial total weight−final weight−substrate weight)/(initial total weight−substrate weight)×100

The above compositions provide good placement (distribution) of the fabric softener for providing good, even protection. It has not previously been recognized that the use of the above softener compositions, especially in the dryer, can provide color protection and/or fabric protection.

Additionally, it is highly desirable for color protection to optionally have at least an effective amount of one additional color protecting ingredient selected from the group consisting of: chlorine scavenger, which provides a surprising amount of protection from tap water in the subsequent wash process; dye transfer inhibitors which can provide additional protection from fabrics that "bleed" fugitive dyes in the laundry process; dye fixatives that provide some stability to dyes on fabrics being laundered; chelant for metals like copper that cause hue shifts in dyes; optionally, soil release polymer, which reduces the deposition and/or redeposition of visible soil to improve the overall fabric appearance; and mixtures thereof. Mixtures of color protectants are desirable, since more than one damage mechanism usually exists. It is also useful, in some instances, to add sun-fade protection, as disclosed in U.S. Pat. No. 5,474,691, Severns, issued Dec. 12, 1995, for DRYER-ADDED FABRIC TREATMENT ARTICLE OF MANUFACTURE CONTAINING ANTI-OXIDANT AND SUNSCREEN COMPOUNDS FOR SUN FADE PROTECTION OF FABRICS.

The different color protecting ingredients can be provided readily in dryer-added compositions and/or articles, since they can be protected and/or separated physically to limit interaction. Additionally, the color protecting ingredients can be mixed with ingredients that promote the proper distribution without affecting the other ingredients. Despite the great advantages provided by a dryer added fabric softener, and the value of the potential benefits, there has not been a recognition of the benefits. Accordingly, many consumers do not avail themselves of the benefits. It is a part of this invention, that dryer added fabric softener compositions are packaged in association with instructions to use the compositions to provide color maintenance benefit and/or appearance benefit.

1. Fabric Softener Component

An essential component (compound) of the invention is at least one fabric softener compound. Typical levels of said fabric softener compounds within the softener compositions are from 1% to 99% by weight of the compositions. However, compositions of the present invention can also contain from about 1% to about 80%, preferably from about 20% to about 70%, more preferably from about 25% to about 60% of fabric softening component.

The fabric softening compound, or compounds, can be selected from cationic, nonionic, amphoteric and/or anionic fabric softening compound.

The typical cationic fabric softening compounds include the water-insoluble quaternary-ammonium fabric softening actives, the most commonly used having been di(long alkylchain)dimethylammonium (C1–C4 alkyl)sulfate or chloride, preferably the methyl sulfate, compounds including the following:

1) di(tallowalkyl)dimethylammonium methyl sulfate (DTDMAMS);
2) di(hydrogenated tallowalkyl)dimethylammonium methyl sulfate;
3) di(hydrogenated tallowalkyl)dimethylammonium chloride (DTDMAC);
4) distearyldimethylammonium methyl sulfate;
5) dioleyldimethylammonium methyl sulfate;
6) dipalmitylhydroxyethylmethylammonium methyl sulfate;
7) stearylbenzyldimethylammonium methyl sulfate;
8) tallowalkyltrimethylammonium methyl sulfate;
9) (hydrogenated tallowalkyl)trimethylammonium methyl sulfate;
10) ($C_{12-14}$ alkyl)hydroxyethyldimethylammonium methyl sulfate;
11) ($C_{12-18}$ alkyl)di(hydroxyethyl)methylammonium methyl sulfate;
12) di(stearoyloxyethyl)dimethylammonium chloride (DSOEDMAC);
13) di(tallowoyloxyethyl)dimethylammonium methyl sulfate;
14) ditallowalkylimidazolinium methyl sulfate;
15) 1-(2-tallowylamidoethyl)-2-tallowylimidazolinium methyl sulfate; and
16) mixtures thereof.

The currently preferred compounds, like 12) and 13) are more environmentally-friendly materials, being rapidly biodegradable quaternary ammonium compounds that are alternatives to the traditionally used di(long alkyl chain) dimethylammonium methyl sulfate. Such quaternary ammonium compounds can contain long chain alk(en)yl groups interrupted by functional groups such as carboxy groups. Said materials and fabric softening compositions containing them are disclosed in numerous publications such as EP-A-0,040,562, and EP-A-0,239,910.

The preferred biodegradable quaternary ammonium compounds and amine precursors, which can also be used, herein typically have the formula (I) or (II), below, more preferably ester quaternary ammonium compounds (EQA) and/or their amine precursors.

Formula I comprises:

$$[(R^1)_{4-p}-N^+-((CH_2)_v-Y-R^2)_p]\ X^-$$

and Formula II comprises:

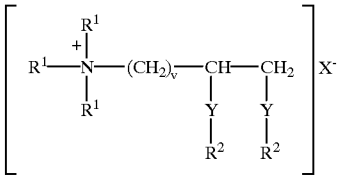

wherein, for any molecule:

each Y=—O—(O)C—, —C(O)—O—, —$NR^4$—C(O)—, or —C(O)—$NR^4$—; preferably —O—(O)C—;

p=1 to 3, preferably 2;

each v=is an integer from 1 to 4, and mixtures thereof, preferably 2 to 3, more preferably 2, each $R^1$ substituent is a short chain $C_1$–$C_6$, preferably $C_1$–$C_3$, alkyl or hydroxy alkyl group, e.g., methyl (most preferred), ethyl, propyl, hydroxy ethyl, and the like, benzyl and mixtures thereof, each $R^2$ is a long chain, saturated and/or unsaturated (Iodine Value of from 0 to about 140), $C_8$–$C_{30}$ hydrocarbyl, or substituted hydrocarbyl substituent and mixtures thereof, the sum of carbons in each $R^2$, plus one when Y is —O—(O)C— or —$NR^4$—(O)C—, is preferably $C_8$–$C_{22}$, more preferably $C_{14}$–$C_{20}$; and the counterion, $X^-$, can be any softener-compatible anion, for example, methylsulfate, ethylsulfate, chloride, bromide, formate, sulfate, lactate, nitrate, benzoate, and the like, and mixtures thereof, preferably methylsulfate or ethyl sulfate, more preferably methyl sulfate.

It will be understood that substituents $R^1$ and $R^2$ of Formula II can optionally be substituted with various groups such as alkoxyl, polyalkoxy, or hydroxyl groups. The preferred compounds can be considered to be diester quaternary ammonium salts (DEQA). At least 25% of the DEQA is in the diester form, and from 0% to about 40%, preferably less than about 30%, more preferably less than about 20%, can be monoester (MEQA, e.g., only one —Y—$R^2$ group, the other —Y—$R^2$ group being replaced by hydrogen).

EQA compounds prepared with fully saturated acyl groups are excellent softeners. However, compounds prepared with at least partially unsaturated acyl groups have advantages (i.e., antistatic benefits) and are highly acceptable for consumer products when certain conditions are met.

Variables that should be adjusted when using unsaturated acyl groups include the Iodine Value of the fatty acids, the odor of fatty acid starting material, and/or the EQA. Any reference to Iodine Value values hereinafter refers to Iodine Value of fatty acyl groups and not to the resulting EQA compound.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc.

Generally, hydrogenation of fatty acids to reduce polyunsaturation and to lower Iodine Value to insure good color and odor stability leads to a high degree of trans configuration in the molecule which raises the melting point. If desired for adjusting melting point, etc., diester compounds derived from fatty acyl groups having low Iodine Value values can also be made by mixing fully hydrogenated fatty acid with touch hydrogenated fatty acid at a ratio which provides an Iodine Value of from about 3 to about 60. During touch hardening the cis/trans isomer weight ratios can be controlled by methods known in the art such as by optimal mixing, using specific catalysts, providing high $H_2$ availability, etc.

It has been found that solvents, including fatty acids, can be used to facilitate processing of the Formula I EQA and/or of the fabric softening composition containing the Formula I EQA.

It has also been found that for good chemical stability of the diester quaternary compound in molten storage, water levels in the raw material should be minimized to preferably less than about 8% and more preferably less than about 5%. Storage temperatures should be kept as low as possible and still maintain a fluid material, ideally in the range of from about 45° C to about 70° C. The optimum storage temperature for stability and fluidity depends on the specific Iodine Value of the fatty acid used to make the diester quaternary and the level/type of solvent selected. Also, exposure to oxygen should be minimized to keep the unsaturated groups from oxidation. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

These biodegradable quaternary ammonium fabric softening compounds can contain the group $C(O)R^1$ which is derived, preferably partially from unsaturated fatty acids. Tallow is a convenient and inexpensive source of long chain alkyl and alkenyl materials. Nonlimiting examples of other useful fatty acids are e.g., oleic acid, and/or fatty acids, and/or hydrogenated, and/or partially hydrogenated fatty acids, which are derived from vegetable oils, and/or partially hydrogenated vegetable oils, such as, canola oil, safflower oil, peanut oil, sunflower oil, corn oil, soybean oil, tall oil, rice bran oil, etc. In general, use of DEQA's made from higher IV fatty acids is possible when the higher IV DEQA is combined with DEQA's made from lower IV fatty acids and/or combined with co-softeners with high melt ranges (e.g., high molecular weight fatty acids).

Suitable higher IV acids are as follows.

| Fatty Acyl Group | $DEQA^1$ | $DEQA^2$ | $DEQA^3$ | $DEQA^4$ | $DEQA^5$ |
|---|---|---|---|---|---|
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | 0 |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |
| Unknowns | 0 | 0 | 6 | 6 | 7 |
| Total | 99 | 99 | 100 | 100 | 102 |
| IV | 86–90 | 88–95 | 99 | 100 | 95 |

Other nonlimiting examples of DEQA's of this invention are as follows:

| Fatty Acyl Group | $DEQA^6$ | $DEQA^7$ | $DEQA^{7A}$ |
|---|---|---|---|
| C14 | 0 | 1 | 3 |
| C16 | 11 | 25 | 26 |
| C18 | 4 | 20 | 25 |
| C14:1 | 0 | 0 | 0 |
| C16:1 | 1 | 0 | 2 |
| C18:1 | 27 | 45 | 40 |
| C18:2 | 50 | 6 | 1 |
| C18:3 | 7 | 0 | 0 |
| Unknowns | 0 | 3 | 3 |
| Total | 100 | 100 | 100 |
| IV | 125–138 | 56 | 42 |

$DEQA^6$ is prepared from a soy bean fatty acid, and $DEQA^7$ and $DEQA^{7A}$ are prepared from a slightly hydrogenated tallow fatty acid

| Fatty Acyl Group | $DEQA^8$ | $DEQA^9$ | $DEQA^{10}$ |
|---|---|---|---|
| Isomyristic acid | — | 1–2 | — |
| Myristic acid | 7–11 | 0.5–1 | — |
| Isopalmitic acid | 6–7 | 6–7 | 1–3 |
| Palmitic acid | 4–5 | 6–7 | — |
| Isostearic acid | 70–76 | 80–82 | 60–66 |
| Stearic acid | — | 2–3 | 8–10 |
| Isoleic acid | — | — | 13–17 |
| Oleic acid | — | — | 6–12 |
| IV | 3 | 2 | 7–12 |

$DEQA^8$–$DEQA^{10}$ are prepared from different commercially available isostearic acids.

Suitable DEQA's can be prepared as a single DEQA from blends of all the different fatty acids that are represented (total fatty acid blend), as well as from blends of mixtures of separate finished DEQA's that are prepared from different portions of the total fatty acid blend.

The unsaturated, including the polyunsaturated, fatty acyl groups provide effective softening, good rewetting characteristics, and good antistatic characteristics.

Preferably, the fabric softening component of the present invention is a quaternary ammonium compound.

The compounds herein can be prepared by standard esterification and quaternization reactions, using readily available starting materials. General methods for preparation are disclosed in U.S. Pat. No. 4,137,180, incorporated herein by reference.

Specific examples of compounds include:

1) N,N-di(tallowoyloxyethyl)-N,N-dimethyl ammonium methyl sulfate;
2) N,N-di(tallowoyloxyethyl)-N-methyl, N-(2-hydroxyethyl) ammonium methyl sulfate;
3) N,N,N-tri(tallowoyloxyethyl)-N-methyl ammonium methyl sulfate;
4) N-(tallowoyloxyethyl)-N-(tallowyl)-N,N-dimethyl-ammonium methyl sulfate;
5) methyl bis (oleyl amidoethyl) 2-hydroxyethyl ammonium methyl sulfate;
6) 1,2-bis(tallowoyloxyethyl)-3,3,3-trimethyl ammoniopropane methylsulfate (DTTMAPMS); and
7) mixtures of any of the above materials.

Of these, compounds 1–5 are examples of compounds of Formula (I); compound 6 is a compound of Formula (II).

Particularly preferred is N,N-di(tallowoyloxyethyl)-N,N-dimethyl ammonium methyl sulfate, where the tallow chains are fully hydrogenated or partially unsaturated.

Other examples of suitable compounds can be obtained by, e.g., replacing "tallowoyl" in the above compounds with, for example, cocooyl, lauroyl, oleoyl, stearoyl, palmitoyl, or the like, the fatty acyl chains being either fully saturated, or preferably at least partly unsaturated; replacing "methyl" in the above compounds with ethyl, propyl, isopropyl, butyl, isobutyl, t-butyl, or the hydroxy substituted analogs of these radicals; and/or replacing "methylsulfate" in the above compounds with chloride, ethylsulfate, bromide, formate, sulfate, lactate, nitrate, and the like, but methylsulfate is preferred.

The level of unsaturation of the tallowoyl chain can be measured by the Iodine Value (IV) of the corresponding fatty acid, which in the present case should preferably be in the range of from 5 to 100.

By "amine precursors thereof" is meant the secondary or tertiary amines corresponding to the above quaternary ammonium compounds. Nonionic Softener Another softening agent which can also be employed in the present invention is a nonionic fabric softener material. Typically, such nonionic fabric softener materials have an HLB of from about 2 to about 9, more typically from about 3 to about 7. In general, the materials selected should be relatively crystalline, higher melting. (e.g., >25° C., preferably >40° C.) and relatively water-insoluble.

The level of nonionic softener in the solid composition, when present, is typically from about 0.1% to about 50%, preferably from about 5% to about 30%.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters. Ethoxylate derivatives of said esters wherein one or more of the unesterified hydroxyl groups in said esters contain from 1 to about 6 oxyethylene units, and mixtures thereof, can be used so long as the overall softener composition's dissolution rate (agitated at 35° C. for about 30 minutes) in water remains less than about 10%, preferably less than about 5%, and more preferably less than about 3%. For the purpose of the present invention, sorbitan esters containing unsaturation (e.g., sorbitan monooleate) can be utilized.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society*, Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties (Tweens®) are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Other preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan.

The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid.

Glycerol and polyglycerol esters, especially glycerol, diglycerol, triglycerol, and polyglycerol mono- and/or di-esters, preferably mono-, are also useful herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g. diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Amine Softener

Color care compositions employed herein can contain as a softener component, at a level of from about 1% to about 60%, preferably from about 5% to about 50%, more preferably from about 10% to about 40%, by weight of the composition of a carboxylic acid salt of a tertiary amine and/or ester amine which has the formula:

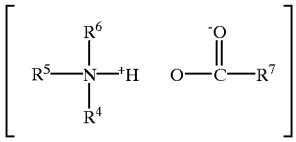

wherein $R^5$ is a long chain aliphatic group containing from about 8 to about 30 carbon atoms; $R^6$ and $R^4$ are the same or different from each other and are selected from the group consisting of aliphatic groups containing from about 1 to about 30, preferably 1, carbon atoms, hydroxyalkyl groups of the Formula —$R^8$OH wherein $R^8$ is an alkylene group of from about 2 to about 30 carbon atoms, and alkyl ether groups of the formula $R^9(OC_nH_{2n})_m$— wherein $R^9$ is alkyl or alkenyl of from about 1 to about 30, preferably 2 or 3, carbon atoms or hydrogen, n is 2 or 3, and m is from about 1 to about 30, preferably from 1 to about 5; wherein $R^4$, $R^5$, $R^6$, $R^8$, and $R^9$ chains can be ester interrupted groups; and wherein $R^7$ is selected from the group consisting of unsubstituted alkyl, alkenyl, aryl, alkaryl and aralkyl of about 8 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a thermal softening point of from about 35° C. to about 100° C.

This component provides the following benefits: superior odor, and/or improved fabric softening performance, compared to similar articles which utilize primary amine or ammonium compounds as the sole fabric conditioning agent. Either $R^4$, $R^5$, $R^6$, $R^7$, $R^8$, and/or $R^9$ chains can contain unsaturation.

Preferably, $R^5$ is an aliphatic chain containing from about 12 to about 30 carbon atoms, $R^6$ is an aliphatic chain of from about 1 to about 30 carbon atoms, and $R^4$ is an aliphatic chain of from about 1 to about 30 carbon atoms. Particularly preferred tertiary amines for static control performance are those containing some unsaturation; e.g., soft tallowalkyldimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and $$C_{18}H_{37}N(C_2H_4O)_{10}H.$$

Preferred fatty acids are those wherein $R^7$ is a long chain, unsubstituted alkyl or alkenyl group of from about 8 to about 30 carbon atoms, more preferably from about 11 to about 17 carbon atoms.

Examples of specific carboxylic acids as a starting material are: formic acid, acetic acid, lauric acid, myristic acid, palmitic acid, stearic acid, oleic acid, oxalic acid, adipic acid, 12-hydroxystearic acid, benzoic acid, 4-hydroxy benzoic acid, 3-chlorobenzoic acid, 4-nitrobenzoic acid, 4-ethylbenzoic acid, 4-(2-chloroethyl)benzoic acid, phenylacetic acid, (4-chlorophenyl)acetic acid, (4-hydroxyphenyl) acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines can result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylarnine stearate, stearyldimethylamine myristate, stearyldimethylamine oleate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

Another type of preferred softener is high molecular weight fatty acid containing at least 20 carbon atoms. These fatty acids can be used in combination with the quaternary softener actives or as part of the fatty acid tertiary amine salts, or mixtures of free fatty acids and fatty acid tertiary amine salts. These fatty acids normally have higher melting ranges, thus can be used to elevate the melting range of the total softener composition if necessary. Non-limiting examples of high molecular weight fatty acids useful in the present invention are arachidic acid ($C_{20}$, eicosanoic acid), docosanoic acid ($C_{22}$, behenic acid), tetracosanoic acid ($C_{24}$, lignoceric acid), triacontanoic acid ($C_{30}$, melissic acid), and mixtures thereof. Behenic acid, arachidic acid, and mixtures thereof are preferred. Behenic acid is most preferred.

Additional fabric softening materials can be used in addition or alternatively to the above fabric softeners. These can be selected from other nonionic, amphoteric and/or anionic fabric softening materials. Disclosure of such materials can be found in U.S. Pat. No. 4,327,133; U.S. Pat. No. 4,421,792; U.S. Pat. No. 4,426,299; U.S. Pat. No. 4,460,485; U.S. Pat. No. 3,644,203; U.S. Pat. No. 4,661,269; U.S. Pat. No. 4,439,335; U.S. Pat. No. 3,861,870; U.S. Pat. No. 4,308,151; U.S. Pat. No. 3,886,075; U.S. Pat. No. 4,233,164; U.S. Pat. No. 4,401,578; U.S. Pat. No. 3,974,076; U.S. Pat. No. 4,237,016 and EP 472,178, incorporated herein by reference.

Further fabric softening components suitable for use herein are the softening clays, such as the low ion-exchange-capacity ones described in EP-A-0,150,531, incorporated herein by reference.

In a slightly different and sometimes broader definition summary, where the fabric softener composition is applied on a substrate such as a dryer-sheet, the preferred level of fabric softener compounds will preferably be from 20% to 99%, more preferably from 30% to 90% by weight, and even more preferably from 35% to 80% by weight.

2. Color Protectant Additives a. Chlorine scavengers

Chlorine scavengers are actives that react with chlorine, or with chlorine- generating materials, such as hypochlorite, to eliminate or reduce the bleaching activity of the chlorine materials. For the dryer-added fabric softener compositions of the present invention , it is suitable to incorporate enough chlorine scavenger to neutralize at least about 1 ppm (part per million) chlorine in the wash water, preferably to neutralize about 2 ppm chlorine, and even more preferably to neutralize about 3 ppm in wash water. The dissolution rate herein is determined without the chlorine scavenger present.

Chlorine is used in many parts of the world to sanitize water. To make sure that the water is safe, a small amount, typically about 1 to 2 ppm of chlorine is left in the water. It has been found that this small amount of chlorine in the tap water can cause fading of some fabric dyes. Heretofore, there has been no suggestion that incorporation of a chlorine scavenger in a dryer-added fabric softener product would provide any benefit. Use of a chlorine scavenger is only of benefit when the fabric is exposed to water containing chlorine. However, the dryer-added product can provide a benefit by placing the chlorine scavenger at a point where it can intercept the chlorine in the wash water of the following wash cycle, especially when the chlorine scavenger is highly water soluble, e.g., an ammonium salt as disclosed hereinafter. Also, if the detergent composition does not contain a chlorine scavenger, or if it is slow to dissolve, the chorine scavenger applied in the dryer will provide protection. The chlorine scavenger herein can be used as part of any prior dryer-added fabric softener composition, but is especially effective when incorporated in the compositions herein. Better distribution, as provided by the compositions herein provides better protection by spreading the chlorine scavenger over the fabric more evenly.

The fabric softener compositions, and especially the preferred compositions herein, can contain an effective amount of chlorine scavenger, preferably selected from the group consisting of:

a. amines and their salts;

b. ammonium salts;

c. amino acids and their salts;

d. polyamino acids and their salts;

e. polyethyleneimines and their salts;

f. polyamines and their salts;

g. polyamineamides and their salts;

h. polyacrylamides; and i. mixtures thereof.

Where any ingredient herein can be classified in more than one place, it should be classified in the place where it can first be mentioned. Typically, the softener composition of the present invention provides enough chlorine scavenger to react with about 0.1 ppm to about 40 ppm, preferably from about 0.2 ppm to about 20 ppm, and more preferably from about 0.3 ppm to about 10 ppm of chlorine present in an average wash liquor. Suitable levels of chlorine scavengers in the dryer-added softener composition of the present invention range from about 0.1% to about 25%, preferably from about 0.5% to about 15%, most preferably from about 1% to about 8%. If both the cation and the anion of the scavenger react with chlorine, which is desirable, the level is adjusted to react with an equivalent amount of available chlorine.

Non-limiting examples of chlorine scavengers include amines, preferably primary and secondary amines, including primary and secondary fatty amines, and alkanolamines; and their salts; ammonium salts, e.g., chloride, bromide, citrate, sulfate; amine-functional polymers and their salts; amino acid homopolymers with amino groups and their salts, such as polyarginine, polylysine, polyhistidine; amino acid copolymers with amino groups and their salts, including 1,5-di-ammonium-2-methyl-panthene dichloride and lysine monohydrochloride; amino acids and their salts, preferably those having more than one amino group per molecule, such as arginine, histidine, and lysine, reducing anions such as sulfite, bisulfite, thiosulfate, and nitrite, antioxidants such as ascorbate, carbamate, phenols; and mixtures thereof.

Preferred chlorine scavengers are water soluble, especially, low molecular weight primary and secondary amines of low volatility, e.g., monoethanolamine, diethanolamine, tris(hydroxymethyl)aminomethane, hexamethylenetetramine, and their salts, and mixtures thereof. Suitable chlorine scavenger polymers include: water soluble amine-functional polymers, e.g., polyethyleneimines, polyamines, polyamineamides, polyacrylamides, and their salts, and mixtures thereof. The preferred polymers are polyethyleneimines, the polyamines, including di(higher alkyl)cyclic amines and their condensation products, polyamineamides, and their salts, and mixtures thereof. Preferred polymers for use in the fabric softening compositions of the present invention are polyethyleneimines and their salts. Preferred polyethyleneimines have a molecular weight of less than about 2000, more preferably from about 200 to about 1500. The water solubility is preferably at least about 1 g/100 g water, more preferably at least about 3 g/100 g water, even more preferably at least about 5 g/100 g water.

Chlorine scavengers for use in the solid dryer-added fabric softener compositions of this invention preferably are solid, e.g., water soluble amines, amine salts, and/or polymers. It is preferred that the chlorine scavenging amine-functional materials be neutralized by an acid, before they are added into the compositions. This neutralization actually converts the amines into ammonium salts. In the salt form, even simple amines and ammonia ($NH_3$) can be used. Preferred salts of this kind are the ammonium salts such as $NH_4Cl$, $(NH_4)_2SO_4$, and the like. Preferred polymeric chlorine scavengers have an average molecular weight of less than about 5,000, more preferably from about 200 to about 2,000, even more preferably from about 200 to about 1,000. Low molecular weight polymers are easier to remove from fabrics, resulting in less buildup of the chlorine scavenger and therefore less discoloration of the fabrics.

Many of the preferred chlorine scavengers are at least fairly water soluble. When these chlorine scavenger actives are present in the compositions of the present invention, the softener composition's dissolution rate criterion (as defined herein before) is determined with the composition not containing the chlorine scavengers.

The fabric conditioning composition for use with the chlorine scavengers can be any of those known in the art and/or previously disclosed by others in patent applications. Compositions that are suitable are disclosed in U.S. Pat. Nos.: U.S. Pat. No. 3,944,694, McQueary; U.S. Pat. No. 4,073,996, Bedenk et al.; U.S. Pat. No. 4,237,155, Kardouche; U.S. Pat. No. 4,711,730, Gosselink et al.; U.S. Pat. No. 4,749,596, Evans et al.; U.S. Pat. No. 4,808,086, Evans et al.; U.S. Pat. No. 4,818,569, Trinh et al.; U.S. Pat. No. 4,877,896, Maldonado et al.; U.S. Pat. No. 4,976,879, Maldonado et al.; U.S. Pat. No. 5,041,230, Borcher, Sr. et al.; U.S. Pat. No. 5,094,761, Trinh et al.; U.S. Pat. No. 5,102,564, Gardlik et al.; and U.S. Pat. No. 5,234,610, Gardlik et al., all of said patents being incorporated herein by reference.

b. Dye Transfer Inhibitors

Dye transfer inhibitors are known in the art of laundry processes, primarily in detergent compositions. For example, European Patent Application 265,257, Elements et al., published Apr. 27, 1988, discloses detergent compositions which prevent dye transfer, containing a detergent active (mixtures of anionic and nonionic are preferred), a detergent builder, and a polyvinylpyrrolidone (PVP) mixture, and German Pat. No. 3,519,012, Weber et al., published Nov. 27, 1986, teaches a detergent composition comprising nonionic surfactants, PVP components, water-soluble cationic components, and builders, to prevent dye transfer during the wash. Dye transfer inhibitors (DTI), such as PVP, appear to solubilize into the wash water to scavenge the free dye molecules, thus suspending the dyes and preventing them from redepositing onto fabrics.

DTI may interact with some detergent actives. For example, detergent compositions containing PVP and anionic surfactants usually have decreased dye transfer inhibition performance compared to those detergents containing PVP and nonionic surfactants. It is believed that anionic surfactants interact with PVP in the wash cycle, and reduce PVP's ability to interact with free dye molecules. It is advantageous to provide DTI by adding them to a dryer-added fabric softener composition to place them on the fabric near the dyes, thus minimizing the interaction with surfactants.

The composition of the present invention contains an effective amount of polymeric dye transfer inhibiting agent (dye transfer inhibitor or DTI). An effective amount is typically an amount of DTI which will provide at least about 0.1 ppm, preferably from about 0.1 ppm to about 100 ppm, more preferably from about 0.2 ppm to about 20 ppm, in the subsequent wash liquor. Preferably, the compositions of the present invention contain from about 0.1% to about 25% of dye transfer inhibitor, more preferably from about 0.5% to about 15%, and even more preferably from about 1% to about 10% for normal dryer-added fabric softener compositions.

Suitable polymer DTIs are disclosed in WO 94/11482, published May 26 1994, which is the same as copending, U.S. patent application of Trinh et al., Ser. No. 08/209,694, filed Mar. 10, 1994, for FABRIC SOFTENING COMPOSITIONS WITH DYE TRANSFER INHIBITORS FOR IMPROVED FABRIC APPEARANCE.

As disclosed in said application, dye transfer inhibitors useful in the present invention include water-soluble polymers containing nitrogen and oxygen atoms, selected from the group consisting of:

(A) polymers, which preferably are not enzymes, with one or more monomeric units containing at least one ═N—C(═O)— group;

(B) polymers with one or more monomeric units containing at least one N-oxide group;

(C) polymers containing both ═N—C(═O)— and N-oxide groups of (A) and (B); and (D) mixtures thereof;

wherein the nitrogen of the ═N—C(═O)— group can be bonded to either one or two other atoms (i.e. can have two single bonds or one double bond).

Dye transfer inhibitors useful in the present invention include water-soluble polymers having the structure:

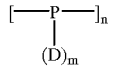

wherein each P is selected from homopolymerizable and copolymerizable moieties which attach to form the polymer backbone, preferably each P being selected from the group consisting of:

vinyl moieties, e.g., [—$C(R)_2$—C(R)—]; other monomeric moieties, e.g., —[[$C(R)_2]_x$—L—], wherein each x is an integer from 1 to 6 and each L is independently selected from the group consisting of:

—N(R)—; —O—; —S—; —O—(O)C—; —C(O)—O—; —S(→O)—; —S(→O)$_2$—; —S(O)—O—; —O—(O)S—; —O—S(O)$_2$—O—;

—O—[Si($R_2$)—O]$_p$—; —C(O)—; and —O—C(O)—O—; and DTI-active groups —N(→O)(R)—; —N(R)C(O)—; —C(O)—N(R)—.

wherein each R is H, $C_{1-12}$ (preferably $C_{1-4}$) alkyl(ene), $C_6$–$C_{12}$ aryl(ene) and/or D, m is from 0 to 2, and p is from 1 to about 6;

wherein each D contains moieties selected from the group consisting of: L moieties; structural moieties selected from the group consisting of linear and cyclic $C_{1-12}$ (preferably $C_{1-4}$) alkyl; $C_{1-12}$ alkylene; $C_{1-12}$ heterocyclic groups, which can also contain the DTI active groups; aromatic $C_{6-12}$ groups; and Rs to complete the group, wherein any linking groups which are attached to each other form linkages that are substantially stable under conditions of use; and wherein the nitrogen atoms can be attached to one, two, or three other atoms, the number of ═N—C(O)— and/or ≡N→O groups present being sufficient to provide dye transfer inhibition, the total molecular weight being from about 500 to about 1,000.000, preferably from about 1,000 to about 500,000, n being selected to provide the indicated molecular weight, and the water solubility being at least about 100 ppm, preferably at least about 300 ppm, and more preferably at least about 1,000 ppm in water at ambient temperature of about 25° C.

A. Polymers with Active ═N—C(═O)— Groups

The most common polymer of this type is PVP. PVP is available from ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as follows: PVP Viscosity Avg. Mol. Wt.=2,500 (K-12); 10,000 (K-15); 24,000 (K-25); and 40,000 (K-30). PVP K-12, K-15, and K-30 are also available from Polysciences, Inc. Warrington, Pa., and PVP K-15, K-25, and K-30 and poly(2-ethyl-2-oxazoline) are available from Aldrich Chemical Co., Inc., Milwaukee, Wis.

The average molecular weight for water-soluble polymers with ═N—C(═O)— groups useful in the present invention is from about 500 to about 100,000, preferably from about 500 to about 40,000, and more preferably from about 1,000 to about 30,000.

B. Polymers with Active N-Oxide Groups

Another useful group of polymeric DTI include water-soluble polymers containing active ≡N→O groups. The nitrogen of the ≡N→O group can be bonded to either one, two, or three other atoms.

One or more of the ≡N→O groups can be part of the pendant D group or one or more ≡N→O groups can be part of the polymerizable P unit or a combination of both.

Where the ≡N→O group is part of the pendant D group, preferred D groups contain cyclic structures with the nitrogen atom of the ≡N→O group being part of the ring or outside the ring. The ring in the D group may be saturated, unsaturated, or aromatic.

Examples of D groups containing the nitrogen atom of the ≡N→O group include N-oxides of heterocyclic compounds such as the N-oxides of pyridine, pyrrole, imidazole, pyrazole, pyrazine, pyrimidine, pyridazine, piperidine, pyrrolidone, azolidine, morpholine, and derivatives thereof. A preferred dye transfer inhibitor is poly(4-vinylpyridine N-oxide) (PVNO). Examples of D groups with the nitrogen atom of the ≡N→O group being outside the ring include aniline oxide and N-substituted aniline oxides.

An example of a polymer wherein the ≡N→O group is part of the monomeric P backbone group is polyethyleneimine N-oxide.

Mixtures of these groups can be present in the polymeric DTIs of B and C.

The amine N-oxide polymers of the present invention typically have a ratio of amine N-oxide to the amine of from about 1:0 to about 1:2. The amount of amine oxide groups present in the polyamine oxide polymer can be varied by appropriate copolymerization or by appropriate degree of N-oxidation. Preferably, the ratio of amine N-oxide to amine is from about 1:0 to about 1:1, most preferred from 1:0 to about 3:1.

The amine oxide unit of the polyamine N-oxides has a PKa L10, preferably PKa L7, more preferably PKa L6.

The average molecular weight of B useful in the present invention is from about 500 to about 1,000,000; more preferably from about 1,000 to about 500,000; most preferably from about 2,000 to about 100,000.

Any polymer backbone above can be used in A or B as long as the polymer formed is water soluble and has dye transfer inhibiting properties. Examples of suitable polymeric backbones are polyvinyls, polyalkylenes, polyesters, polyethers, polyamide, polyimides, polyacrylates, and copolymers and block copolymers thereof, and mixtures thereof.

C. Copolymers Including Active ═N—C(═O)— and/or ≡N→O Groups Effective polymeric DTI agents can include those formed by copolymerizing mixtures of monomeric, oligomeric, and/or polymeric units containing active ═N—C(═O)— and/or active ≡N→O groups (e.g., copolymers and/or block copolymers of PVP and PVNO). Other suitable DTI copolymers include those in which an effective amount of monomeric, oligomeric, and/or polymeric units containing active ═N—C(═O)— groups and/or active ≡N→O groups is copolymerized with "filler" monomeric, oligomeric, and/or polymeric units which do not contain active ═N—C(═O)— or ≡N→O groups but which impart other desirable properties to the DTI copolymer, such as increased water solubility or enhanced fabric substantivity [e.g., block copolymer of PVP (G about 60%) and polyvinylimidazole].

Some of the preferred dye transfer inhibitors are fairly water soluble. When these dye transfer inhibitors are present in the compositions of the present invention, the softener composition's dissolution rate criterion (as defined herein before) is determined with the composition not containing the dye transfer inhibitors.

c. Dye Fixatives

Dye fixatives are similar to dye transfer inhibitors, but tend to be more water insoluble. They act primarily by inhibiting removal of the dye rather than intercepting it in the water phase and keeping it suspended like the dye transfer inhibitors.

Suitable dye fixatives are disclosed in U.S. Pat. No. 5,632,781, Shinichi et al., issued May 27, 1997; U.S. Pat. No. 4,583,989, Toshio et al., issued Apr. 22, 1986; U.S. Pat. No. 3,957,574, Edward, issued May 18, 1975; U.S. Pat. No. 3,957,427, Chambers, issued May 18, 1976; and U.S. Pat. No. 3,940,247, Derwin et al., issued Feb. 24, 1976, all of said patents being incorporated by reference.

The dye fixatives are used in at least an effective amount, typically from about 0.1% to about 50%, preferably from about 0.5% to about 30%, more preferably from about 1% to about 10%.

d. Chelants The composition can also comprise from about 0.1% to about 50% of by weight of the composition, preferably from about 0.2% to about 20%, more preferably about 0.5% to about 10%, and most preferably from about 1% to about 7% by weight of the composition of "chelant" color care agent, preferably color care agent having the formula:

$$(R^1)_2N(CX_2)_nN(R^2)_2$$

wherein each X is selected from the group consisting of hydrogen (preferred), linear or branched, substituted or unsubstituted alkyl groups having from 1 to about 10 (preferably 1 or 2) carbons atoms and substituted or unsubstituted aryl having at least 6 carbon atoms (preferably from 6 to about 22), and mixtures thereof, n is an integer from 0 to 6, preferably 2 or 3; each $R^1$ and $R^2$ is independently selected from the group consisting of hydrogen; alkyl; aryl; alkaryl; aralkyl; hydroxyalkyl; polyhydroxyalkyl; $C_{1-10}$, preferably $C_{2-3}$, alkyl groups substituted with one (preferred), or more (preferably 2 or 3) carboxylic acid or phosphonic acid groups, or salts thereof; polyalkylether having the formula $—((CH_2)_yO)_zR^3$ where each $R^3$ is hydrogen (preferred) or a linear, branched, substituted or unsubstituted alkyl chain having from 1 to about 10 (preferably from about 1 to about 4) carbon atoms and where y is an integer from 2 to about 10 (preferably 2 or 3) and z is an integer from 1 to 30 (preferably from 2 to about 5); the group $—C(O)R^4$ where each $R^4$ is selected from the alkyl; alkaryl; aralkyl; hydroxyalkyl; polyhydroxyalkyl, polyalkylether, and alkyl groups substituted with one (preferred), or more (preferably 2 or 3) carboxylic acid or phosphonic acid groups, or salts thereof as defined in $R^1$ and $R^2$; and $—CX_2CX_2N(R^5)_2$ with no more than one of $R^1$ and $R^2$ being $CX_2CX_2N(R^5)_2$ and wherein each $R^5$ is selected from the alkyl; alkaryl; aralkyl; hydroxyalkyl; polyhydroxyalkyl, polyalkylether, and alkyl groups substituted with one (preferred), or more (preferably 2 or 3) carboxylic acid or phosphonic acid groups, or salts thereof as defined in $R^1$ and $R^2$; and one $R^1$ and one $R^2$ can combine to form a cyclic compound.

The available alkyl groups include linear or branched, substituted or unsubstituted alkyl groups typically having from about 1 to about 22 carbon atoms, preferably from about 1 to about 10 carbon atoms. Most preferred alkyl groups include methyl, ethyl, propyl, isopropyl, and mixtures thereof. The available aryl groups include substituted or unsubstituted aryl groups typically having from 6 to about 22 carbon atoms. Substitutions can include alkyl chains as earlier described thereby providing alkaryl or aralkyl groups having from about 6 to about 22 carbon atoms. Preferred aryl, aralkyl and alkaryl groups include phenyl, benzyl and mesityl. The available hydroxyalkyl and polyhydroxyalkyl groups include linear or branched, hydroxy substituted groups typically having from 1 to about 22 carbon atoms. Preferred groups include hydroxymethyl, hydroxyethyl, 1-hydroxypropyl and 2-hydroxypropyl. The available polyalkoxy (polyalkylether) groups include those having the formula: $—((CH_2)_yO)_zR^3$ wherein the integer y typically ranges from 2 to about 10 with 2 and 3 the most preferred; the group $—(CH_2)_y—$ can include both linear and branched chains; preferred groups include ethoxy and isopropoxy groups; the integer z typically ranges from about 1 to about 30 with lower levels of alkoxylation, preferably ethoxylation, being preferred; $R^3$ is typically hydrogen or an alkyl groups having 1 to 5 carbon atoms. The group $—C(O)R^4$ can also be employed where $R^4$ is alkyl; alkaryl; arylalk; hydroxyalkyl; polyhydroxyalkyl, polyalkylether, carboxylic acid, alkyl dicarboxylic acid, phosphonic acid, alkyl phosphonic acid as defined above, and mixtures thereof.

Remaining $R^1$ and $R^2$ possibilities include linear or branched alkyl carboxylic acid groups and water soluble salts thereof having the general formula $—(CH_p(R^7)_q)_tC(O)O^{(-)}M^{(+)}$ wherein t is an integer from 1 to about 5, p is an integer from 1 to 3, p+q=2 and $M^{(+)}$ is a water soluble monovalent cation such as hydrogen, alkali metal, etc. As t typically ranges from about 1 to about 5, the total number of carbons typically does not exceed 6 and $M^{(+)}$ is a water soluble cation such as alkali metal or other available groups such as ammonium or substituted ammonium. Also available are dicarboxylic acid groups, including the water soluble salts, which have from about 2 to about 5 carbons atoms, and linear, branched or polyfunctional substituted branched alkyldicarboxylic acids and water soluble salts thereof also having from about 2 to about 5 carbon atoms. Preferred carboxylate chelants include ethylenediaminetetraacetic acid (EDTA), N-hydroxyethylethylenediaminetriacetic acid, nitrilotriacetic acid (NTA), ethylenediamine tetraproprionic acid, ethylenediamine-N,N'-diglutamic acid, 2-hydroxypropylenediamine-N,N'-disuccinic acid, triethylenetetraaminehexaacetic acid, diethylenetriaminepentaacetic acid (DETPA), and ethanoldiglycines, including their water-soluble salts such as the alkali metal, ammonium, and substituted ammonium salts thereof, and mixtures thereof Phosphonic acid chelants and water soluble salts thereof and linear, branched or polyfunctional substituted branched alkylphosphonic acids and water soluble salts thereof can be employed as $R^1$ and $R^2$. In both cases, the number of carbon atoms typically ranges from about 1 to about 5. Preferred groups include ethylenediaminetetrakis (methylenephosphonic acid), diethylenetriamine-N,N,N',N",N"-pentakis(methane phosphonic acid) (DETMP) and 1-hydroxyethane-1,1-diphosphonic acid (HEDP), including their water-soluble salts such as the alkali metal, ammonium, and substituted ammonium salts thereof, and mixtures thereof.

$R^1$ and $R^2$ can also be the group $CX_2CX_2N(R^5)_2$. However, when the group is present, no more than one of $R^1$ and $R^2$ at any one time can be the group $CX_2CX_2N(R^5)_2$. Furthermore, each $R^5$ can be alkyl; alkaryl; aralkyl; hydroxyalkyl; polyhydroxyalkyl, polyalkylether, alkoxy, polyalkoxy alkyl carboxylic acid, alkyl dicarboxylic acid, phosphonic acid and alkyl phosphonic acid as defined above for $R^1$ and $R^2$. Preferably, when any one of $R^1$ and $R^2$ is present as the group $CX_2CX_2N(R^5)_2$, then each $R^5$ is preferably, alkyl or hydroxyalkyl group as defined above. Additionally, either of $R^1$ and of $R^2$ can combine to form a cyclic substituent. Suitable examples include the moiety:

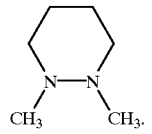

To provide suitable color care properties, the preferred color care chelants according to the present invention consist of at least about 3% by weight of the compound of nitrogen, preferably at least about 7% and more preferably at least about 9% by weight of the compound. The preferred color care chelants according to the present invention have a total number of carbon atoms in the groups $R^1$ and $R^2$ of about 50 or less, more preferably of about 40 or less and more preferably of about 20 or less.

Most preferably, each $R^1$ and $R^2$ is independently selected from the group consisting of hydrogen, linear alkyl groups having from 1 to 5 carbon atoms and linear hydroxyalkyl groups having from 1 to 5 carbon atoms. Especially preferred are the groups ethyl, methyl, hydroxyethyl, hydroxypropyl, and mixtures thereof. While each of $R^1$ and $R^2$ can be individually selected, the preferred color care component according to the present invention involves the situation wherein each of $R^1$ and $R^2$ is hydroxyalkyl group having from 1 to 5 carbon atoms. A preferred list of chelants includes N,N,N',N'tetraethylethylenediamine, 2-{[2-(dimethylamino)ethyl]-methylamino}ethanol, bis-(2-hydroxyethyl)N,N'-dimethylethylenediamine, bis(octyl)-N,N'-dimethylethylenediamine, N,N,N'N'-tetrakis(2-hydroxypropyl) ethylenediamine, N,N,N',N",N"-penta(2-hydroxypropyl)diethlyenetriamine, N,N'-diethylethyldiamine, N,N,N'-trimethylethylenediamine, 1,3-pentadiamine, N,N-dimethylethylenediamine, 2-(2-aminoethylamino)ethanol, N,N'-dimethylcthylenediamine, 1,3-diamino-2-hydroxypropane, N'-methyl-2,2'-diaminodiethylamine, N-(2-aminoethyl)-1,3-propanediamine. Particulalry preferred is N,N,N',N'-tetrakis (2-hydroxypropyl) ethylenediamine and N,N,N',N",N", penta(2-hydroxypropyl)diethylenetriamine. Such materials are commercially available from a number of sources including BASF of Washington, N.J. under the tradename QUADROL and PENTROL.

These compounds are believed to provide protection as chelants and are preferred. However, other chelants can also be used, so long as they are compatible and can bind with metals that cause hue shifts in fabric dyes. Other suitable chelants are described in the copending allowed U.S. patent application of Rusche et al., Ser. No. 08/753,167, filed Nov. 25, 1996 for CHELATING AGENTS FOR IMPROVED COLOR FIDELITY said application being incorporated herein by reference.

These chelants (which as used herein also includes materials effective not only for binding metals in solution but also those effective for precipitating metals from solution) include citric acid, citrate salts (e.g., trisodium citrate), isopropyl citrate, 1-hydroxyethylidene-1,1-diphosphonic acid (etidronic acid), available from Monsanto as Dequest RTM 2010, 4,5-dihydroxy-m-benzene-sulfonic acid/sodium salt, available from Kodak as Tiron RTM, diethylenetriaminepentaacetic acid, available from Aldrich, ethylene diaminetetraacetic acid (EDTA), ethylene diamine-N,N'-disuccinic acid (EDDS, preferably the S, S isomer), 8-hydroxyquinoline, sodium dithiocarbamate, sodium tetraphenylboron, ammonium nitrosophenyl hydroxylamine, and mixtures thereof. Most preferred of these chelants are EDTA and especially citric acid and citrate salts.

3. Optional Ingredients a. Soil Release Polymers.

Optionally, the compositions herein contain from 0% to about 50%, preferably from about 5% to about 40%, more preferably from about 10% to about 30%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred soil release agents are polymers of the generic formula:

$$X—(OCH_2CH_2)_n—[O—C(O)—R^1—C(O)—O—R^2)_u—[O—C(O)—R^1—C(O)—O)—(CH_2CH_2O)_n—X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene. 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy- 1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds.

The value for each n is at least about 6, and preferably is at least about 10. The value for each n usually ranges from about 12 to about 200. Typically, the value for each n is in the range of from about 24 to about 100.

Suitable nonionic soil release agents are disclosed in U.S. Pat. Nos.: U.S. Pat. No. 4,702,857, Gosselink, issued Oct. 27, 1987; U.S. Pat. No. 4,711,730, Gosselink and Diehl, issued Dec. 8, 1987; U.S. Pat. No. 4,713,194, Gosselink issued Dec. 15, 1987; and U.S. Pat. No. 4,749,596, Evans, Huntington, Stewart, Wolf, and Zimmerer, issued Jun. 7, 1988, said patents being incorporated herein by reference.

The polymeric soil release agents useful in the present invention preferably includes anionic and/or cationic polymeric soil release agents. Suitable anionic polymeric or oligomeric soil release agents are disclosed in U.S. Pat. No. 4,018,569, Trinh, Gosselink and Rattinger, issued Apr. 4. 1989, said patent being incorporated herein by reference. Other suitable polymers are disclosed in U.S. Pat. No. 4,808,086, Evans, Huntington, Stewart, Wolf, and Zimmerer, issued Feb. 24, 1989, said patent being incorporated herein by reference. Suitable cationic soil release polymers are described in U.S. Pat. No. 4,956,447, Gosselink, Hardy, and Trinh, issued Sept. 11, 1990, said patent being incorporated hereinbefore by reference.

b. Perfume

Fabric softening products typically contain perfume to provide an olfactory aesthetic benefit and/or to serve as a signal that the product is effective. The perfume ingredients and compositions of this invention are the conventional ones known in the art. Selection of any perfume component, or amount of perfume, is based on aesthetic considerations. Suitable perfume compounds and compositions can be found in the art including U.S. Pat. Nos.: U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. The free perfume is typically used at a level of from about 0.1% to about 15%, preferably from about 0.5% to about 10%, more preferably from about 1% to about 5%, by weight of the softener composition.

Many of the art-recognized perfume compositions are relatively substantive, as described hereinafter, to maximize their odor effect on fabrics. A substantive perfume is one that contains a sufficient percentage of substantive perfume ingredients so that when the perfume is used at normal levels in products, it deposits a desired odor on the treated fabric. Substantive perfume materials are those that deposit on fabrics via the dryer-added product in the tumble drying process and are detectable by people with normal olfactory acuity. Such materials typically have vapor pressures lower than that of the average perfume material.

Perfumes can be classified according to their volatility. The volatile, low boiling, perfume ingredients typically have boiling points lower than about 250° C. These ingredients are usually lost in the tumble drying process. Less volatile perfume ingredients having boiling points of from about 250° C. or higher are more substantive. Many of the perfume ingredients as discussed hereinafter, along with their odor characters, and their physical and chemical properties, such as boiling point and molecular weight, are given in "Perfume and Flavor Chemicals (Aroma Chemicals)," Steffen Arctander, published by the author, 1969, incorporated herein by reference.

Examples of the volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, para-cymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of less volatile, high boiling perfume ingredients are: amyl cinnamic aldehyde, iso-amyl salicylate, benzophenone, benzyl salicylate, beta-caryophyllene, cedrene, cinnamic alcohol, coumarin, dimethyl benzyl carbinyl acetate, ethyl vanillin, ethylene brassylate, eugenol, iso-eugenol, flor acetate, galaxolide (1,3,4,6,7,8-hexahydro-4,6,6,7,8,8-hexamethyl-cyclopenta-gama-2-b-enzopyran), heliotropine, 3-cis-hexenyl salicylate, hexyl cinnamic aldehyde, hexyl salicylate, lilial (para-tertiarybutyl-alpha-methyl hydrocinnamic aldehyde), lyral (4-(4-hydroxy-4-methyl pentyl)-3-cyclohexene-10-carboxaldehyde), methyl cedrylone, methyl dihydro jasmonate, gamma-methyl ionone, methyl-beta-naphthyl ketone, musk indanone, musk ketone, musk tibetene, nerolidol, patchouli alcohol, phenyl-ethyl phenyl acetate, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

In general, the degree of substantivity of a perfume is roughly proportional to the percentage of substantive perfume material used. The free perfume useful in the composition of the present invention typically contains at least about 20%, preferably at least about 30%, more preferably at least about 40%, by weight of the composition, of substantive perfume ingredients.

c. Perfume/Cyclodextrin Complexes

The free perfume in dryer-added softener product is often lost before it is needed. Perfumes can be subject to damage and/or loss by the action of, e.g., oxygen, light, heat, and the tumble drying process, etc. For example, due to the high energy input and large air flow in the drying process used in the typical automatic laundry dryers, a large part of the free perfume provided by dryer-added softener products is lost out the dryer vent. Even for less volatile components, as described hereinbefore, only a small fraction remains on the fabrics after the drying cycle. The loss of the highly volatile fraction of the perfume, as described hereinbefore, is much higher. Usually the loss of the highly volatile fraction is practically total. Due to this effect, the free perfumes used in dryer-added fabric softener compositions, have been composed mainly of less volatile, high boiling (having high boiling points), perfume components. as disclosed hereinbefore, to maximize survival of the odor character during storage and use and thus provide better "fabric substantivity." The main function of a small fraction of the highly volatile, low boiling (having low boiling points), perfume components in these perfumes is to improve the fragrance odor of the product itself, rather than impacting on the treated fabric. However, some of the volatile, low boiling perfume ingredients can provide a fresh and clean impression to the fabric, and it is highly desirable that these ingredients be deposited and present on the fabric.

Cyclodextrin inclusion complexes (perfume/cyclodextrin, or perfume/CD, complexes), as described hereinafter, of the high boiling, the moderately volatile, and the low boiling perfume ingredients are stable (a) throughout the mixing of the complexes with the remainder of the compositions, e.g., the molten fabric softener mixes, and the coating of the resulting fabric softening compositions onto flexible substrates to form dryer-added fabric conditioning sheets, (b) during the application of the composition to the fabrics, e.g., during the drying of the wet fabrics in tumble dryers, and (c) during use, e.g., during the wearing of the dry fabrics. The content of the perfume in the cyclodextrin, e.g., β-cyclodextrin, inclusion complex is typically from about 5% to about 15%, more normally from about 7% to about 12%.

Cyclodextrin/perfume complex is typically used at a level of from about 1% to about 50%, preferably from about 2% to about 40%, more preferably from about 5% to about 30%, by weight of the softener composition.

As used herein, the term "cyclodextrin" (CD) includes any of the known cyclodextrins such as unsubstituted cyclodextrins containing from six to twelve glucose units, especially, alpha-, beta-, gamma-cyclodextrins, and mixtures thereof, and/or their derivatives, and/or mixtures thereof, that are capable of forming inclusion complexes with odor materials. Beta-cyclodextrin is the most preferred cyclodextrin. Alpha-, beta-, and gamma-cyclodextrins can be obtained from, among others. Cerestar USA, Hammond, Ind.; and Wacker Chemicals (USA), New Canaan, Conn. Examples of cyclodextrin derivatives suitable for use herein are methyl-β-CD, hydroxyethyl-β-CD, and hydroxypropyl-β-CD of different degrees of substitution (DS), also available from Cerestar USA and Wacker Chemicals (USA).

The individual cyclodextrins can also be linked together, e.g., using multifunctional agents to form oligomers, polymers, etc. Examples of such materials are available commercially from Cerestar USA and from Aldrich Chemical Company (β-CD/epichlorohydrin copolymers).

Processes for preparation of cyclodextrin/perfume complexes and selection of the preferred complex particle size for best perfume release are disclosed in U.S. Pat. No. 5,102,564 issued Apr. 7, 1992 and U.S. Pat. No. 5,234,610 issued Aug. 10, 1993, to Gardlik et al., said patents being incorporated herein by reference.

d. Free Cyclodextrin

Free cyclodextrin is also useful in the dryer-added composition of the present invention to control undesirable odor which can be body odor or environmental odor such as food and cigarette odor that can be deposited on fabrics.

A single type of cyclodextrin can be used. It is also desirable to use mixtures of cyclodextrins to provide odor control for a variety of odor materials. Such mixtures, e.g., can provide broader odor control by complexing with a wider range of odorous materials. The particle sizes of the cyclodextrins herein are selected to improve the pick-up of odors and/or the release, and especially the rate-of-release, of any perfume from a complex. The preferred particle size range is typically between about 0.001 and 10 microns, more preferably between about 0.05 and 5 microns. It is highly desirable that at least an effective amount of the active be in complexes having the said particle sizes. It is desirable that at least about 75%, preferably at least about 80% and more preferably at least about 90% of the complex that is present have the said particle sizes. It is even better if essentially all of the complex has the said particle sizes.

The methods of preparation of preferred particle sizes and methods of particle size determination are disclosed in Case 4840C2, Trinh et al. Compositions herein can comprise from about 5% to about 70%, preferably from about 10% to about 60%, more preferably from about 15% to about 50%, of uncomplexed cyclodextrin and/or from about 0.5% to about 60%, preferably from about 1% to about 50%, more preferably from about 5% to about 40%, of perfume/cyclodextrin complex and from about 30% to about 95%, preferably from about 40% to about 90%, of fabric softening agent selected from the above-defined cationic and nonionic fabric softeners and mixtures thereof.

e. Antioxidants

Suitable antioxidants include ascorbate, carbamate, phenols; and mixtures thereof. Other examples of antioxidants that can be added to the compositions of this invention are propyl gallate, available from Eastman Chemical Products, Inc., under the trade names Tenox® PG and Tenox S-1, and dibutylated hydroxy toluene, available from UOP Process Division under the trade name Sustane® BHT.

f. The dryer-added compositions can also contain some additional ingredients, especially bacteriocides, colorants, preservatives, and/or optical brighteners.

5. Form of the Composition

The fabric softening composition can take a variety of physical forms including foams and solid forms such as solid particulate forms. However, in the preferred substrate product embodiment, the dryer-added fabric softener composition of the present invention is provided as part of an article of manufacture in combination with a dispensing means such as a flexible substrate which effectively releases the composition in an automatic tumble clothes dryer. Such dispensing means can be designed for single usage or for multiple uses. Preferably the composition is applied onto a sheet substrate to form a dryer sheet product. The substrates in such products are typically non-woven fabric substrates, paper, foams, etc. Typical and preferred dispensing means are described in U.S. Pat. No. 5,102,564, issued Apr. 7, 1992 to Gardlik et al., incorporated herein by reference.

When the dispensing means is a flexible substrate, e.g., in sheet configuration, the fabric conditioning composition is releasably affixed on the substrate to provide a weight ratio of conditioning composition to dry substrate ranging from about 10:1 to about 0.5:1, preferably from about 5:1 to about 1:1. The substrates especially useful herein are rayon and/or polyester non-woven fabrics, as described in, e.g. U.S. Pat. Nos. 5,578,234 and 5,470,492, issued, respectively, Nov. 26, 1996 to Corona et al. and Nov. 28, 1995 to Childs et al., said patents being incorporated herein by reference.

Substrates

Non-limiting examples of the substrates useful herein are rayon and/or polyester non-woven fabrics having basis weights of from about 0.4 oz/yd$^2$ to about 0.7 oz/yd$^2$, preferably from about 0.5 oz/yd$^2$ to about 0.6 oz/yd$^2$, more preferably from about 0.54 oz/yd$^2$ to about 0.56 oz/yd$^2$. These substrates are typically prepared using, e.g., rayon and/or polyester fibers having deniers of from about 2 to about 8, preferably from about 3 to about 6, and more preferably about 6. Typically, the fiber is a continuous filament that is laid down, in a pattern that results in a multiplicity of layers and intersections between overlayed portions of the filament, on a belt, preferably foraminous, and then the fiber intersections are glued and/or fused into fiber-to-fiber bonds by a combination of glue and/or heat and pressure, typically a temperature of from about 237° C. to about 231° C., preferably to from about 237° C. to about 233° C., more preferably from about 237° C. to about 235° C. and/or pressure of from about 40 psig to 0 psig, more preferably from about 10 psig to 0 psig, to provide thickness (loft).

The breaking strength is preferably at least about 3 lbs/sq-in in each direction. I.e., from about 3 to about 14, preferably from about 6 to about 12, more preferably from about 7 to about 9, lbs/sq-in.

The substrate dispensing means will normally carry an effective amount of the fabric treatment composition disclosed herein. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g. most preferably from about 1 g to about 10 g.

The modulus of elasticity, as calculated by Hook's Law, stress/strain is preferably from about 1.5 to 4.2 pli, preferably from about 2.0 to 4.0 pli, more preferably from about 2.3 to 2.8 pli in the cross direction and 3.4 to 3.8 pli in the machine direction.

The breaking strengths preferably include a tear strength of at least about 3 pli in both the cross direction and the machine direction, preferably from about 5 to about 8 pli in the cross direction and from about 6 to about 10 pli in the machine direction.

Usage

The articles of this invention can be used for imparting the fabric treatment composition to fabric (clothes) to provide softening, antistatic, and/or improved appearance effects to fabric in an automatic laundry dryer. Generally, the method of using the articles of the present invention comprises: commingling pieces of damp fabric by tumbling said fabric under heat, e.g., via a flow of hot air in an automatic clothes dryer with an article comprising an effective amount of the softener composition of this invention.

The present invention relates to improved solid dryer-activated fabric softener articles that provide improved fabric appearance benefits, especially color benefits, to the consumer.

Process

Reduction or Inhibition of the Loss of Fabric Appearance and Recovery of Appearance The benefit provided by the use of the present invention is that the loss in the fabric appearance is reduced or inhibited, e.g. it is meant that fabrics which are treated with a softening composition have a reduced or inhibited loss of appearance versus fabrics which were not treated with a softening composition. More preferably, the benefit is particularly on colored fabrics where the treated fabrics show a reduced or inhibited fabric discoloration, or even restoration.

The types of discoloration and/or appearance benefits provided depend upon the compositions, the fabrics and/or the conditions. The preferred fabric softener compositions and products comprising the compositions with peak melt temperatures above about 40° C., etc. and substrate can provide protection and restoration from damage created by abrasion. Compositions containing a chlorine scavenger primarily provide a benefit in the subsequent wash step when the residual chlorine in the water attacks bleach sensitive dyes. Compositions containing dye transfer inhibitors and dye fixatives provide protection in the subsequent wash when there is a mixed load of fabrics comprising a fabric with a dye that is solubilized. The dye transfer inhibitor, however, can also provide improvement in appearance when a fabric has already been stained by preventing redeposition of the dye once it is resolubilized. Soil release agents assist in prevention of stain deposition which affects the general fabric appearance. Accordingly, it is important to instruct the consumer about the type of damage that is avoided/repaired, so that the consumer knows when to use the product and when it is most effective.

Thus, the invention also comprises packages containing dryer activated fabric softener composition preferably comprising at least one fabric softener component as discussed hereinbefore, for inhibiting or reducing loss and/or recovery of fabric appearance, and/or said fabric softener composition preferably having the following properties:

1) the composition has a peak melt temperature between about 40° C. and about 75° C. more preferably between about 50° C. and about 75° C.;
2) the composition's fraction of enthalpy below about 40° C. is less than about 40%. preferably less than about 30%, and more preferably less than about 20%, as measured by DSC;
3) the composition's dissolution rate in water is less than about 10%, preferably less than about 5%, and more preferably less than about 3%;
4) optionally, but desirably, the composition has Wet Slip properties, and
5) optionally, but desirably, the composition's release rate from the sheet is more than about 65%. preferably more than about 75%, and more preferably more than about 85% of fabric softener active, said packages being in association with information that will inform the consumer, by words and/or by pictures, that use of the compositions will provide fabric care benefits which preferably include color maintenance benefits, and optionally, but preferably, where the fabric softener actives are preferably highly unsaturated and/or otherwise biodegradable. In a highly desirable variation, the information, including the package information, informs the consumer that the use of the fabric softener active provides color maintenance and/or color restoration for fabrics. Additionally, the information preferably discloses the type of damage that is affected and/or the conditions that lead to the damage, to permit the consumer to make a rational decision on how important the use of the dryer-added fabric softener composition/product will be. Such information helps the consumer understand the limits of the product as well as the benefits. For example, if the consumer has water that is high in e.g., copper, the composition/product containing the chelant is especially useful and the instructions could comprise the information relative to the source of the damage. Similarly, the compositions/product containing chlorine scavenger, dye transfer inhibitor, dye fixative, and/or soil release agent could explain the benefit which is provided in the following wash step.

Effective use of the compositions herein requires informed consumers, especially where, as herein, the benefits provided are not normally associated with the particular type of product.

Laundered Garment/Fabric Appearance Performance Evaluation Procedures

A) Multiple Cycle Benefit Repeated Laundering with Dryer-Added Product Treatment:

Replicates of colored cotton garments are washed with a conventional detergent composition (Tide® Powder). The washed garments are immediately tumble-dried with a dryer-added product, e.g., dryer sheet containing a fabric conditioner composition of the present invention. This laundry cycle process is repeated eight times. The treated fabrics are then graded against the control fabrics that are similarly washed but do not receive the treatment for the eight cycles with the fabric conditioner composition.

Fabric Bundles and Test Fabric Tracers. The tracers are added to a bundle consisting of 70% cotton fabric and 30% polyester fabric to a total of about 7 pounds (about 3.2 Kg) dry weight.

The standard tracers used to assess appearance losses due to abrasion are a black cotton knit sock., a red and blue striped cotton baby jumper (or a red and blue stripped rugby shirt), and a black cotton twill pant-weight mock garment.

A moss green cotton tee shirt which is found to be sensitive to chlorine damage is used to assess the protection of fabrics from chlorine damage. Free chlorine level in wash and rinse water is typically about 1 ppm.

A pre-damaged rust cotton tee shirt is used as tracer to assess the ability of formulas to restore the effects of heavy metal damage. The rust tee shirts are identically predamaged by soaking in an about 25 ppm solution of an about 2:1:1 mixture of $Fe^{3+}$:$Mn^{2+}$:$Cu^{2+}$ heavy metal salts in water for about 4 hours with stirring about every half an hour. The damaged tee shirts are then rinsed in about 70° F. (about 21° C.) water in a washing machine and dryed in a tumble dryer for about 30 mins.

Performance Grading. The dried garments are assessed for their loss of fabric appearance against a control by a grading panel of three persons using the Scheffe analysis to provide grading in Panel Score Units (PSU). The average of three graders is reported. Unless otherwise noted the controls are identical colored cotton garments washed with a conventional detergent composition but which was tumble dried without contact with a dryer-added fabric conditioner composition. A positive PSU value indicates a better appearance performance (PSU scale: 0=no difference, 1=I think there is a difference, 2=I know there is a difference, 3=I know there is a lot of difference, 4=I know there is a whole lot of difference).

B) Single Cycle Benefit: Dryer-Added Product Treatment Following Repeated Laundering Without A Dryer-Added Product:

Replicates of colored cotton garments are washed with a conventional detergent composition (Tide® Powder). The washed garments are immediately tumble-dried one time with a dryer sheet containing a fabric conditioner composition of the current invention, and graded against the control garments that do not receive the fabric conditioner composition treatment for the whole eight cycles.

In the invention description herein, including in the following non limiting examples, all percentages, parts and ratios are on a weight basis unless otherwise stated, and all references are incorporated herein by reference.

EXAMPLES

In the examples the abbreviated component indications have the following meanings:

Fabric Conditioners (1) DEQA[1]: Di(soft tallowoyloxyethyl)dimethylammonium methyl sulfate with 25% 7018 FA, as described below, as solvent (2) DEQA[2]: Di(soft tallowoyloxyethyl) hydroxyethylmethylammoniun methyl sulfate with 18% partially hydrogenated tallow fatty acid solvent (3) DTDMAMS: Di(hydrogenated tallowalkyl) dimethylammonium methyl sulfate (4) 7018FA: 70:30 Stearic Acid:Palmitic Acid (IV=0) Industrene 7018 sold by Witco (5) TS-20: Polyoxyethylene-20 Sorbitan Tristearate (Glycosperse TS-20, sold by Lonza (6) SMS: Sorbitan Mono Stearate (7) Neodol 45-13: C14-C15 linear primary alcohol ethoxylate, sold by Shell Chemical Company (8) Ethofat DA-3: Proprietary ethoxylated nonionic surfactant, sold by Akzo Chemical Inc.

(9) 9022FA: 90% Arachidic and Behenic Acid (Hystrene 9022 sold by Witco)

Heavy Metal Chelant and Chlorine Scavenger

(10) SDASA: 1:2 ratio of stearyl dimethyl amine: triple pressed stearic acid

(11) TPED: N,N,N',N'-Tetrakis(2-hydroxypropyl) ethylenediamine (Quadrol, sold by BASF)

Dye Transfer Inhibitor Agent

(12) PVP K-15: Polyvinylpyrrolidone available from BASF Corp.

Optional Ingredients

(13) Complex: Beta-Cyclodextrin/Perfume Complex

(14) Clay: Calcium Bentonite Clay (Bentonite L sold by Southern Clay Products)

(15) Perfume:

Example 1

Colored garments are washed with a conventional laundry detergent, rinsed, and tumble-dried in the presence of dryer added fabric conditioner products with the following composition:

| | Composition | | |
|---|---|---|---|
| Component | A Wt. % | B Wt. % | C Wt. % |
| DEQA[1] | — | 50.0 | — |
| DEQA[2] | 30 | — | — |
| DTDMAMS | — | — | 50 |
| 7018FA | — | — | 50 |
| TS-20 | 15 | — | — |
| SMS | 15 | — | — |
| SDASA | 19 | 25 | — |
| TPED | — | 3 | — |
| Complex | 16.5 | 16.5 | — |
| Clay | 3 | 4 | — |
| Perfume | 1.5 | 1.5 | — |
| Active Weight (g/sheet) | 2.4 | 2.4 | 1.8 |

The compositions of Example 1 are mixed homogeneously and impregnated onto a non-woven polyester sheet having dimensions of about 6¾ in×12" (about 17.1 cm×30.5 cm) and weighing about 1 gram. (A similar non-woven substrate is also used to make dryer-added sheets for the Examples hereinafter). The fabric conditioner compositions have the following approximate physical properties and amount of active release from the sheet at the end of the drying cycle (previously described):

| | Compositions | | |
|---|---|---|---|
| | A | B | C |
| Melt Peak | 57.9 | 59.7 | 59.8 |
| % Enthalpy (<40° C.) | 27.7 | 12.7 | 10.8 |
| % Dissolution Loss | 5.7 | 3.9 | 1.3 |
| Wet Slip | 3 | 3 | 3 |
| Active Release (% of Total Active) | 85% | 80% | 80% |

Maintenance of Appearance Benefit—Protection Against Effects of Abrasion: The laundered garment appearance performance of these compositions is compared to garments washed and tumbled-dry without a dryer sheet treatment as described above, both after eight treatment cycles. All three compositions provide an laundered garment appearance improvement over no dryer sheet treatment, as follows:

| Composition | PSU vs. No treatment |
|---|---|
| A | 1.9 |
| B | 2.3 |
| C | 2.2 |

All three compositions provide an laundered garment appearance improvement over no dryer sheet treatment Color Protection from Chlorine and Heavy Metals: The compositions of Example 1 are used to treat fabric tracers susceptible to chlorine damage and damage by heavy metals. Each fabric bundle containing appropriate tracers is treated for eight cycles. The appearance performance (PSU) of each of the above compositions is evaluated vs. a no dryer sheet treatment control. Composition B containing the heavy metal chelant (TPED) provides the best restoration of heavy metal fabric damage, and Compositions A and B containing the chlorine scavengers (SDASA and TPED) provide the best chlorine damage protection, as follows:

| Composition | Heavy Metal Damage Tracer | Chlorine Damage Tracer |
|---|---|---|
| A | 1.3 | 2.7 |
| B | 2.5 | 2.9 |
| C | 0.9 | 0.9 |

Composition B containing the heavy metal chelant (TPED) provides the best restoration of heavy metal fabric damage. Compositions A and B containing the chlorine scavengers (SDASA and TPED) provide the best chlorine damage protection.

Example 2

A level study was conducted with the following composition:

| Component | Composition D Wt. % |
|---|---|
| DEQA[1] | 54 |
| SDASA | 32 |

-continued

| Component | Composition D Wt. % |
|---|---|
| TPED | 4 |
| Clay | 10 |

Coating weights varied between about 0.6 and about 1.8 grams per sheet are used for the evaluation. Approximately 80% of the softener is released from sheets containing all coating weights studied.

Maintenance of garment appearance by repeated use of dryer sheet

An initial coating weight of at least about 1 g/sheet of softener is required to achieve at least an about 2 PSU improvement in laundered fabric appearance on abrasion tracers after eight cycles of repeated dryer sheet treatment vs. no dryer sheet use control.

All the above coating weights (from about 0.6 to about 1.8 grams per sheet) tested are able to improve laundered fabric appearance of the heavy metal pre-damaged tracers, and the chlorine sensitive tracer by at least about 2 PSU after eight cycles of repeated dryer sheet treatment vs. no dryer sheet control.

Restoration of garment appearance by use of a dryer sheet after repeated laundry cycles with no dryer sheet treatment An initial coating weight of at least about 1 g/sheet is required to achieve at least an about 2 PSU improvement in laundered garment appearance on abrasion tracers after seven cycles of no dryer sheet treatment followed by one cycle of dryer sheet treatment vs. a no dryer sheet use control.

An initial coating weight of at least about 1.0 g/sheet is required to achieve at least an about 2 PSU improvement in laundered garments on heavy metal chelant tracers after 7 cycles of no dryer sheet treatment followed by one cycle of dryer sheet treatment vs. a no dryer sheet use control. Initial coating weights of less than about 1.0 g/sheet results in uneven restoration of fabric color damage.

Damage to chlorine sensitive tracers is not improved after 7 cycles of no dryer sheet treatment followed by one cycle of dryer sheet treatment at any of the coating weights tested vs. a no dryer sheet use control.

Comparative Example 3

The following compositions are used to make the dryer sheets of Comparative Example 3:

| Component | Composition E Wt. % | Composition F Wt. % |
|---|---|---|
| DTDMAMS | 50 | — |
| 7018FA | — | 50 |
| Neodal 45-13 | — | 50 |
| Ethofat DA3 | 50 | — |
| Coating Weight (gram/sheet) | 1.8 | 1.8 |

The above compositions are mixed homogeneously and impregnated onto a non-woven polyester substrate sheet. The fabric conditioner compositions have the following approximate physical properties and amount of active release from the sheet at the end of the drying cycle (as previously described):

| | Composition E | Composition F |
|---|---|---|
| Melt Peak | 40.9 | 60 |
| % Enthalpy (<40° C.) | 78 | 40 |
| % Dissolution Loss | 11.5 | 6.5 |
| Wet Slip | 3 | 1 |
| Active Release (% of total active) | 85 | 80 |

The composition of Comparative Example 3E has an undesirable % enthalpy below 40° C., and the composition of Comparative Example 3F does not contain a softener active and has an undesirable wet slip property. These compositions and products are outside the scope of the current composition invention. The laundered garment appearance performance of these compositions are compared to garments washed and tumbled-dry without a dryer sheet treatment as described above. There are eight cycles of repeated dryer sheet treatment vs. no dryer sheet treatment control using the abrasion tracers. Laundered garment appearance benefit is much poorer than previous examples:

| Composition | PSU vs. No treatment |
|---|---|
| E | 0.7 |
| F | 0.3 |

Laundered garment appearance performance is much poorer than previous examples.

Example 4

The following compositions are used to make dryer sheets:

| Component | Composition G Wt. % | Composition H Wt. % |
|---|---|---|
| DEQA[1] | 57 | 57 |
| 7018FA | 25 | — |
| 9022FA | — | 25 |
| Complex | 16.5 | 16.5 |
| Perfume | 1.5 | 1.5 |

The above compositions are mixed homogeneously and impregnated onto a non- woven polyester sheet. The fabric conditioner compositions have the following approximate physical properties and amount of active release from the sheet at the end of the drying cycle (previously described):

| | Compositions G | Compositions H |
|---|---|---|
| Melt Peak | 58 | 61 |
| % Enthalpy <40° C. | 15 | 11 |
| % Dissolution | 3 | 2 |
| Wet Slip | 3 | 3 |
| Active Release (% of total active) | 78 | 70 |

The use of 9022FA in place of 7018FA effectively raised the melt peak temperature and reduced the % enthalpy <40° C.

of the fabric conditioner composition. Compositions G and H both provided a greater than 2 PSU laundered garment/fabric appearance benefit over no dryer sheet treatment on abrasion tracers.

Example 5

The following compositions containing a dye transfer inhibitor are used to make dryer sheets:

| | Composition | |
|---|---|---|
| Component | I Wt. % | J Wt. % |
| DEQA[1] | 48 | — |
| DTDMAMS | — | 54 |
| 7018FA | 25 | — |
| 9022FA | — | 25 |
| PVP K15 | 15 | 15 |
| Clay | — | 3 |
| Complex | 10 | — |
| Perfume | 2 | 3 |

What is claimed is:

1. A dryer-activated fabric softener product comprising.

A. substrate and

B. dryer-activated fabric softener composition comprising, as a color protecting ingredient, an effective amount of chlorine scavenger selected from the group consisting of ammonium sulfate, ammonium chloride, and the water soluble salts of monoethanolamine, diethanolamine, tris (hydroxymethyl)aminomethane, hexamethylenetetramine, and mixtures thereof.

2. The product of claim 1 wherein the level of chlorine scavenger in the composition is from about 0.1% to about 25%.

3. The product of claim 2 wherein the level of chlorine scavenger in the composition is from about 0.05% to about 15%.

4. The product of claim 3 wherein the level of chlorine scavenger in the composition is from about 1% to about 8%.

5. The process of adding the product of claim 1 to an automatic laundry dryer with fabrics to provide fabric care appearance benefits to said fabrics.

* * * * *